US005951176A

United States Patent [19]

Ueda et al.

[11] Patent Number: 5,951,176

[45] Date of Patent: Sep. 14, 1999

[54] THERMAL TRANSFER PRINTER WITH CASSETTE TRANSFER MECHANISM

[75] Inventors: Kazuo Ueda; Hideki Yorozu; Yuusai Ishitobi, all of Iwate-ken, Japan

[73] Assignee: Alps Electric Co., Ltd., Tokyo, Japan

[21] Appl. No.: 09/009,466

[22] Filed: Jan. 20, 1998

[30] Foreign Application Priority Data

| | | | |
|---|---|---|---|
| Jan. 22, 1997 | [JP] | Japan | 9-023170 |
| Jan. 29, 1997 | [JP] | Japan | 9-029785 |
| Feb. 19, 1997 | [JP] | Japan | 9-051043 |

[51] Int. Cl.[6] ..... B41J 35/22

[52] U.S. Cl. ..... 400/206; 347/214

[58] Field of Search ..... 400/206, 208; 347/213, 214

[56] References Cited

U.S. PATENT DOCUMENTS

| | | | |
|---|---|---|---|
| 5,267,802 | 12/1993 | Parnell et al. | 400/208 |
| 5,538,351 | 7/1996 | Miyano | 400/206 |
| 5,720,562 | 2/1998 | Ogawa | 400/492 |
| 5,739,839 | 4/1998 | Iwai et al. | 347/214 |
| 5,777,652 | 7/1998 | Takeuchi | 400/206 |

FOREIGN PATENT DOCUMENTS

| | | | |
|---|---|---|---|
| 0 703 089 A1 | 3/1996 | European Pat. Off. . | |
| 60-253578 | 12/1985 | Japan . | |
| 2-103173 | 4/1990 | Japan | 347/214 |
| 2-103174 | 4/1990 | Japan | 347/214 |

*Primary Examiner*—Ren Yan
*Assistant Examiner*—Daniel J. Colilla
*Attorney, Agent, or Firm*—Brinks Hofer Gilson & Lione

[57] ABSTRACT

A cassette transfer mechanism for a thermal transfer printer with a cassette platform and a cassette holder for holding a plurality of ribbon cassettes. The cassette transfer mechanism transfers a ribbon cassette between the cassette platform and the cassette holder by driving the platform and holder to come into and out of contact with each other. The cassette holder and the cassette platform each have movable members and stationary members for engaging a ribbon cassette. A further embodiment includes elastic members on the cassette holder for abutting the reels of the ribbon cassette to elastically bias the reels in one direction.

7 Claims, 10 Drawing Sheets

THERMAL TRANSFER PRINTER WITH CASSETTE TRANSFER MECHANISM

BACKGROUND OF THE INVENTION

1. Field of the Invention

The present invention relates to a thermal transfer printer of the type in which a desired ribbon cassette is selected from a plurality of ribbon cassettes respectively held by a plurality of cassette holding portions of a cassette holder and in which the selected ribbon cassette is transferred to a cassette platform to perform desired printing.

2. Description of the Related Art

In a common thermal transfer printer, paper and an ink ribbon are arranged before a platen, and, while moving a thermal head mounted on a carriage in a printing column direction in a condition in which the thermal head is held in press contact with the platen through the intermediation of the ink ribbon and the paper, a plurality of heat generating elements are selectively caused to generate heat in accordance with printing signals, whereby the ink of the ink ribbon is melted and transferred to the paper to thereby effect printing.

Due to its high printing quality, low noise, low cost, ease of maintenance, etc., such a thermal printer is widely used as an output apparatus for a computer, a word processor, or the like.

To make such a thermal transfer printer more convenient to use and achieve a reduction in running cost, there is known, as has been proposed in U.S. Pat. No. 5,538,351, a thermal transfer printer in which there is provided a cassette holder holding a plurality of ribbon cassettes containing inks of different colors in cassette holding portions. The cassette holder is arranged opposite to the carriage, and a ribbon cassette having an ink of a desired color is selected from the ribbon cassettes held by the cassette holding portions of the cassette holder. The selected ribbon cassette is transferred from the cassette holding portion to a cassette platform arranged on the carriage to thereby make it possible to perform recording by the thermal head.

FIG. 19 schematically shows the construction of the essential part of a cassette holding portion of the cassette holder and the cassette platform of such a conventional thermal transfer printer. In FIG. 19, a ribbon cassette 11 is held by the cassette holding portion 20, and no ribbon cassette 11 is attached to the cassette platform 22.

As shown in the drawing, the cassette holding portion 20 is equipped with a pair of arms 20*a* and 20*b* for holding the ribbon cassette 11. Around the base portions of these arms 20*a* and 20*b*, torsion coil springs (not shown) are wound so that the ribbon cassette 11, held by the cassette holding portion 20, may be reliably held due to the resilient force of the springs, whereby the ribbon cassette 11 is prevented from being detached from the cassette holding portion 20.

On the side opposite to the cassette holding portion 20 of the cassette holder, there is arranged a carriage 21, on which there is mounted a cassette platform 22 as shown in FIG. 19 so as to be capable of being brought into contact with and moved away from the cassette holding portion 20. A pair of arms 22*a* and 22*b* are arranged on either end of the cassette platform 22. Torsion coil springs (not shown) are wound around the base portions of these arms 22*a* and 22*b* so that the ribbon cassette 11 placed on the cassette platform 22 may be constantly held due to the resilient force of these springs, whereby the ribbon cassette 11 is prevented from being detached from the cassette platform 22.

The distance between the forward ends of the arms 22*a* and 22*b* when the ribbon cassette 11 is not placed on the cassette platform 22 is smaller than the distance between the forward ends of the arms 20*a* and 20*b* of the cassette holding portion 20 when the ribbon cassette 11 is being held by the cassette holding portion 20. Further, the distance between the forward ends of the arms 20*a* and 20*b* when the ribbon cassette 11 is not being held by the cassette holding portion 20 is smaller than the distance between the forward ends of the arms 22*a* and 22*b* of the cassette platform 22 when the ribbon cassette 11 is placed on the cassette platform 22 (See FIG. 19).

Next, the operation of transferring the ribbon cassette 11, held by the cassette holding portion 20 of the thermal transfer printer constructed as described above, to the cassette platform 22, will be described.

First, as shown in FIG. 19, the cassette platform 22 is moved to a position opposite to the cassette holding portion 20 holding the ribbon cassette 11. In this condition, the cassette platform 22 is moved by a driving means (not shown) so as to approach the cassette holding portion 20. As described above, the distance between the forward ends of the arms 22*a* and 22*b* of the cassette platform 22 is smaller than the distance between the forward ends of the arms 20*a* and 20*b* of the cassette holding portion 20 when the ribbon cassette 11 being is held by the cassette holding portion 20. Thus, the forward ends of the arms 22*a* and 22*b* get inside the arms 20*a* and 20*b* of the cassette holding portion 20, and, while moving the arms 20*a* and 20*b* apart from each other against the resilient force of the torsion coil springs, enter the cassette holder 20. When the cassette platform 22 further moves toward the cassette holding portion 20, the ribbon cassette 11, which has been held by the arms 20*a* and 20*b* of the cassette holding portion 20, is elastically held between the arms 22*a* and 22*b* of the cassette platform 22 (See FIG. 20). In this way, the ribbon cassette 11 is transferred from the cassette holding portion 20 to the cassette platform 22.

Next, the cassette platform 22, which has thus received the ribbon cassette 11, is brought back to the carriage 21, whereby the desired ribbon cassette 11 is mounted on the carriage 21, thereby making it possible to perform printing by using this ribbon cassette 11 (See FIG. 21).

When the printing by using the desired ribbon cassette 11 has been completed, the ribbon cassette 11 is transferred from the cassette platform 22 to the cassette holder 20. This transfer operation will be described below.

First, as shown in FIG. 21, the cassette platform 22 mounted on the carriage 21 is moved to a position opposite to the cassette holding portion 20 of the cassette holder holding no ribbon cassette.

Then, the cassette platform 22 is moved toward the cassette holding portion 20 by a driving mechanism (not shown). Then, the forward ends of the arms 22*a* and 22*b* of the cassette platform 22 are positioned outside the forward ends of the arms 20*a* and 20*b* of the cassette holding portion 20 (See FIG. 22).

In this condition, the cassette platform 22 is moved toward the cassette holding portion 20. Then, as shown in FIG. 23, the arms 20*a* and 20*b* of the cassette holding portion 20 move while outwardly moving the arms 22*a* and 22*b* of the cassette platform 22 apart from each other, and the ribbon cassette 11 is transferred from the cassette platform 22 to the cassette holding portion 20.

Next, the cassette platform 21 with no ribbon cassette 11 mounted thereon is brought back to the carriage 21 (FIG. 24).

When the ribbon cassette 11 has been transferred and the cassette platform 22 with no ribbon cassette 11 mounted thereon has been returned to the carriage 21, the ribbon cassette 11 for next printing is selected, and the above operations of FIGS. 19 through 21 are conducted again, whereby a ribbon cassette 11 accommodating an ink ribbon of another color is transferred from the cassette holding portion 20 to the cassette platform 22.

In such a conventional thermal transfer printer, to reduce the load of the take-up bobbin when taking up the ink ribbon during printing, the frictional resistance between the reels cassette case, i.e., between the supply reel, around which the ink ribbon is wound, and the take-up reel, and the ribbon cassette case supporting these reels, is made as small as possible, whereby the torque of a motor or the like constituting the driving source for rotating the take-up bobbin is reduced to thereby achieve a reduction in power consumption.

However, in this conventional thermal transfer printer, the arms 20*a* and 20*b* of the cassette holding portion 20 and the arms 22*a* and 22*b* of the cassette platform 22 are formed of materials different from those of the cassette holding portion 20 and the cassette platform 22, respectively. Further, since torsion coil springs (not shown) for elastically holding the ribbon cassette 11 are wound around the arms 20*a*, 20*b*, 22*a* and 22*b*, the number of parts is rather large, resulting in the cost of the thermal transfer printer being rather high. Further, the large number of parts leads to a poor assembly efficiency.

Further, when the ribbon cassette 11 is attached to or detached from the cassette holding portion 20 or the cassette platform 22 for transfer, any positional deviation of the forward ends of the arms 20*a*, 20*b*, 22*a* and 22*b* may make it impossible for the ribbon cassette 11 to be transferred.

For example, there is no problem when, as shown in FIG. 19, the positioning of the cassette platform 22 and the cassette holding portion 20 is effected accurately. However, when the right-hand arm 22*a* of the the cassette platform 22 is deviated to the outside of the right-hand arm 20*a* of the cassette holding portion 20, or when the left-hand arm 22*b* of the the cassette platform 22 is deviated to the outside of the left-hand arm 20*b* of the cassette holding portion 20, it is impossible for the cassette platform 22 to correctly transfer the ribbon cassette 11, so that it is necessary to provide a positioning sensor (not shown) to effect accurate positioning, resulting in a higher cost.

Further, when transferring the ribbon cassette 11 from the cassette holding portion 20 to the cassette platform 22 or from the cassette platform 22 to the cassette holding portion 20, the cassette holder 20 vibrates, so that the ribbon cassette 11 held by the cassette holding portion vibrates, with the result that the above-mentioned reels make some idle running, thereby causing slackness in the ink ribbon wound around the reels. When this ribbon cassette 11, in which the ink ribbon have become slack, is transferred from the cassette holding portion 20 to the cassette platform 22, the slack ink ribbon may get caught by the platen, the upper portion of the thermal head, etc., so that, when the thermal head is lowered when starting printing, the ink ribbon will get wrinkled, thereby making it impossible for printing to be effected in an appropriate manner.

SUMMARY OF THE INVENTION

The present invention has been made with a view toward solving the above problems in the prior art. It is an object of the present invention to provide a thermal transfer printer in which the number of parts is reduced and in which the ribbon cassette can be transferred in a stable manner.

Another object of the present invention is to provide a thermal transfer printer comprising:

- a platen arranged in a printing column direction;
- a carriage disposed on the platen;
- a carriage driving mechanism for reciprocally driving the carriage along the platen
- a ribbon cassette accommodating an ink ribbon in a case main body;
- a cassette platform mounted on the carriage and equipped with a cassette engagement portion to engage with the ribbon cassette, the cassette engagement portion including a movable member and a stationary member;
- a cassette holder arranged at a position opposite to the cassette platform and having a plurality of cassette holding portions each having a cassette engagement portion engageable with the ribbon cassette, each cassette engagement portion having a movable member and a stationary member;
- a driving mechanism for moving the cassette platform towards and away from the cassette holder; and for activating the driving mechanism to cause the cassette platform to be moved towards and away from the cassette holder and for activating the carriage driving mechanism to cause the carriage to move.

A further object of the present invention is to provide a thermal transfer printer wherein in the cassette engagement portion of the cassette platform and in the cassette engagement portion of each cassette holding portion the movable members and the stationary members are arranged at a predetermined interval parallel to the moving direction of the sides of the cassette engagement portion and the cassette holding portion and spaced apart at a predetermined interval.

A further object of the present invention is to provide a thermal transfer printer wherein biasing members are mounted to the movable members and wherein the movable members are elastically biased toward the stationary members by the biasing members.

A further object of the present invention is to provide a thermal transfer printer further comprising a ribbon take-up bobbin arranged on the carriage and engaged with a take-up reel of the ribbon cassette so that the ribbon take-up bobbin is rotated in a ribbon take-up direction when transferring the ribbon cassette.

A further object of the present invention is to provide a thermal transfer printer comprising:

- a platen arranged in a printing column direction;
- a carriage driving mechanism for reciprocally driving the carriage along the platen;
- a carriage arranged so as to be capable of reciprocating along the platen;
- a ribbon cassette accommodating an ink ribbon in a case main body;
- a cassette platform mounted on the carriage and equipped with a cassette engagement portion to be engaged with the ribbon cassette the cassette engagement portion including a movable member and a stationary member;
- a cassette holder arranged at a position opposite to the cassette platform and having a plurality of cassette holding portions each having a cassette engagement portion engageable with the ribbon cassette, each cassette engagement portion having a movable member and a stationary member;
- a driving mechanism for bringing the cassette platform towards and away from the cassette holder; and
- a cassette transfer mechanism for activating the driving mechanism to cause the cassette platform to be brought towards and away from the cassette holder and for activating the carriage driving mechanism to cause the carriage to move, which makes it possible for the ribbon cassette to be transferred between the cassette platform and a cassette holding portion means for transferring the ribbon cassette through the following operations (a) through (f):

moving the carriage to a position where the movable and stationary members of the cassette platform are somewhat deviated from opposed positions with respect to the movable and stationary members of the cassette holding portion;

driving the driving mechanism to move the cassette platform in a direction toward the cassette holding portion to a position where the movable members of the cassette platform and movable member of the the cassette holding portion cross each other;

moving the carriage along the platen to cause the engagement portion of the movable member which is not engaged with the ribbon cassette yet to move away from the stationary member;

driving the driving mechanism to bring the cassette platform closer to the cassette holding portion so that the ribbon cassette may be held between the cassette platform and the cassette holding portion;

moving the carriage along the platen to release the ribbon cassette and to transfer the released ribbon cassette; and driving the driving mechanism to move the cassette platform away from the cassette holding portion to thereby return the cassette platform to a predetermined position on the carriage.

A further object of the present invention is to provide a thermal transfer printer comprising:

a platen arranged in a printing column direction;

a carriage disposed on the platen;

a carriage driving mechanism for reciprocally driving the carriage along the platen;

a ribbon cassette accommodating ink ribbon in a case main body;

a cassette platform mounted on the carriage and equipped with a cassette engagement portion to be engaged with the ribbon cassette, the cassette engagement portion including a movable member and a stationary member;

a cassette holder arranged at a position opposite to the cassette platform and having a plurality of cassette holding portions each having a cassette engagement portion engageable with the ribbon cassette, each cassette engagement portion having a movable member and a stationary member;

a driving mechanism for bringing the cassette platform towards and away from the cassette holder; and elastic members which are attached to said cassette holding portion and which abut the reels of the ribbon cassette when the ribbon cassette is held by the cassette holding portion so as to elastically bias the reels in one direction.

A further object of the present invention is to provide a thermal transfer printer wherein the cassette holding portion is equipped with a stationary member integrally formed with the cassette holding portion and a movable member attached to the cassette holding portion, and wherein the ribbon cassette having a supply reel and a take up reel having bobbin engagement holes with inner peripheral surfaces, mounted on the cassette platform is transferred to the cassette holding portion through an operation of moving the cassette platform with the ribbon cassette mounted thereon in a direction perpendicular to the carriage moving direction to bring it into contact with the cassette holding portion and an operation of moving the cassette platform in the carriage moving direction, the elastics member abutting the inner peripheral surfaces of bobbin engagement holes of the reels when the ribbon cassette is held by the cassette holding portion by means of the movable and stationary members.

A further object of the present invention is to provide a thermal transfer printer wherein mounting hole are formed in the cassette holding portion, wherein protruding portions protruding from the mounting holes are provided on the elastic members mounted to the mounting holes, and wherein the protruding portions are inserted into the bobbin engagement holes of the ribbon cassette to cause the elastic members to abut the movable member side of the inner peripheral surfaces of the bobbin engagement holes to elastically bias them.

A further object of the present invention is to provide a thermal transfer printer wherein the elastic member has a cylindrical base and a substantially semi-cylindrical protruding portion with an outer wall formed along the circumference of the base, the base being mounted to the mounting hole of the cassette holding portion.

A further object of the present invention is to provide a thermal transfer printer wherein the protruding portion of the elastic member has an expanding slot in the height direction provided in the outer wall thereof.

DETAILED DESCRIPTION OF THE PREFERRED EMBODIMENT

An embodiment of the thermal transfer printer of the present invention will be described with reference to FIGS. 1 through 16.

Figure 1:
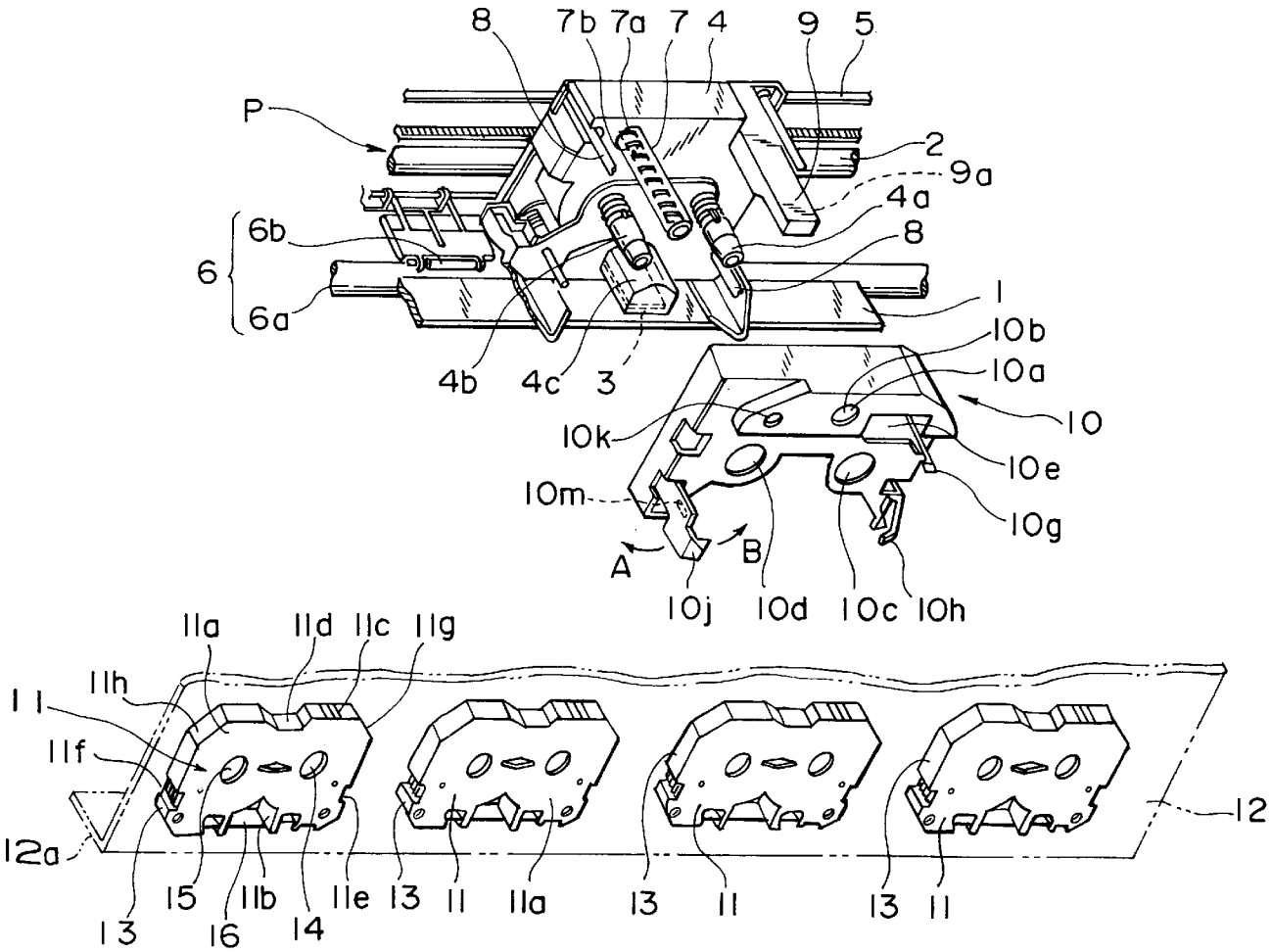
FIG. 1 is a general perspective view schematically illustrating the construction of a thermal transfer printer in accordance with the present invention.

As shown in the essential-part perspective view of FIG. 1, in the thermal transfer printer of the present invention, a flat platen 1 is arranged substantially horizontally in the main body of the printer. A guide shaft 2, which extends parallel to this platen 1, connects the side plates (not shown) of the main body case to each other.

A carriage 4, which can reciprocate on the guide shaft 2, is arranged over the platen 1 so as to face it. The carriage 4 carries a thermal head 3 which can be brought into contact with and moved away from the platen 1. A plurality of heat generating elements (not shown) are aligned on the thermal head 3.

Behind the carriage 4, a toothed belt 5 for causing the carriage 4 to reciprocate on the guide shaft 2 are wound around pulleys (not shown). Further, behind the platen 1, there is arranged a paper feeding mechanism 6 composed of a paper feeding roller 6*a* and an auxiliary roller 6*b*, by means of which paper (not shown) is fed between the platen 1 and the thermal head 3.

A take-up bobbin 4*a* and a supply bobbin 4*b* protrude from the surface of the carriage 4.

Further, a cover 4*c* for protecting the thermal head 3 is provided in the central part of the lower end portion of the carriage 4 (FIG. 1). A lift gear 7 formed of synthetic resin is rotatably arranged on the carriage 4 at a position nearer to the upper end thereof. On the outer periphery of this lift gear 7, there are formed a plurality of screw teeth 7*a* and screw grooves 7*b*, which are arranged at equal intervals. Further, in the upper left corner of the carriage 4, a bar-like guide pin 8 formed of metal is arranged.

Further, in the right upper corner of the carriage 4, there is arranged a sensor mounting member 9 equipped with a sensor (not shown) for detecting the kind, position, etc. of a ribbon cassette described below.

Further, attached to the carriage 4 is a cassette platform 10 capable of carrying a ribbon cassette 11 described below. The cassette platform 10 is movable in a direction perpendicular to the direction of movement of the carriage 4 (the direction in which it is moved so as to be brought towards and separated from a cassette holding portion 13 described below). In that portion of the cassette platform 10 which is nearer to the upper end thereof, there is formed a screw hole 10*a*. In this screw hole 10*a*, there are formed screw teeth 10*b* adapted to be engaged with the screw grooves 7*b* of the lift gear 7. By rotating the lift gear 7, the cassette platform 10 can be moved in a direction perpendicular to the direction of movement of the carriage 4.

Further, on one side of that portion of the cassette platform 10 which is nearer to the upper end thereof, there is provided a guide hole 10*k* in which a bearing (not shown) is embedded. The guide pin 8 of the carriage 4 is inserted into this guide hole 10*k*, whereby the guide pin 8 serves as a guide when the cassette platform 10 moves in the direction perpendicular to the direction of movement of the carriage 4.

Further, in that portion of the cassette platform 10 which is nearer to the lower end thereof, there are formed a pair of holes 10*c* and 10*d*, through which the take-up bobbin 4*a* and the supply bobbin 4*b* of the carriage 4 are passed. In the upper corner on the other side of the cassette platform 10, there is formed a rectangular hole 10*e*, through which the above-mentioned sensor mounting member 9 is passed.

Further, in the vicinity of the rectangular hole 10*e* of the cassette platform 10, there is formed a stationary claw 10*g*, which is a stationary member formed integrally with the cassette platform 10 by molding. At the forward end of this stationary claw 10*g*, there is formed a hook-like engagement portion.

In the right lower corner of the cassette platform 10 also, there is formed a stationary claw 10*h*, which is a stationary member formed integrally with the cassette platform 10 by molding. The width dimension of this stationary claw 10*h* is such that it can be engaged with a protruding portion 11*p* of an engagement portion 11*e* of the ribbon cassette 11 described below.

Further, at a position opposite to the stationary claw 10*h* of the cassette platform 10, there is provided a movable claw 10*j*, which is a movable member spaced apart from the stationary claw 10*h* by a predetermined distance. The movable claw 10*j* is formed as a member separate from the cassette platform 10 and rotatable with respect to the cassette platform 10. At the forward end of the movable claw 10*j*, there is formed a hook-like engagement portion.

Further, a protrusion 10*m* adapted to be engaged with an engagement portion 11*f* of the ribbon cassette 11 protrudes from the inner side surface of the movable claw 10*j*.

Further, a torsion coil spring (not shown) is wound around the rotation center of the movable claw 10*j*, and elastically biases the engagement portion at the forward end of the movable claw 10*j* constantly toward the stationary claw 10*h*, that is, in the direction of an arrow B.

The ribbon cassette 11 accommodates, in a main body case 11*a*, a long ink ribbon 16 whose end portions are respectively wound around a take-up reel 14 and a supply reel 15. All the ribbon cassettes 11 have the same configuration and the same size irrespective of the color, etc. of the ink ribbon 16 accommodated therein. The take-up reel 14 and the supply reel 15 are rotatably accommodated in the main body case 11*a*. When the ribbon cassette is mounted on the cassette platform 10, the take-up reel 14 and the supply reel 15 are respectively engaged with the take-up bobbin 4*a* and the supply bobbin 4*b* of the carriage 4. By rotating the take-up bobbin 4*a*, the ink ribbon 16 is taken up by the take-up reel 14.

Figure 2:
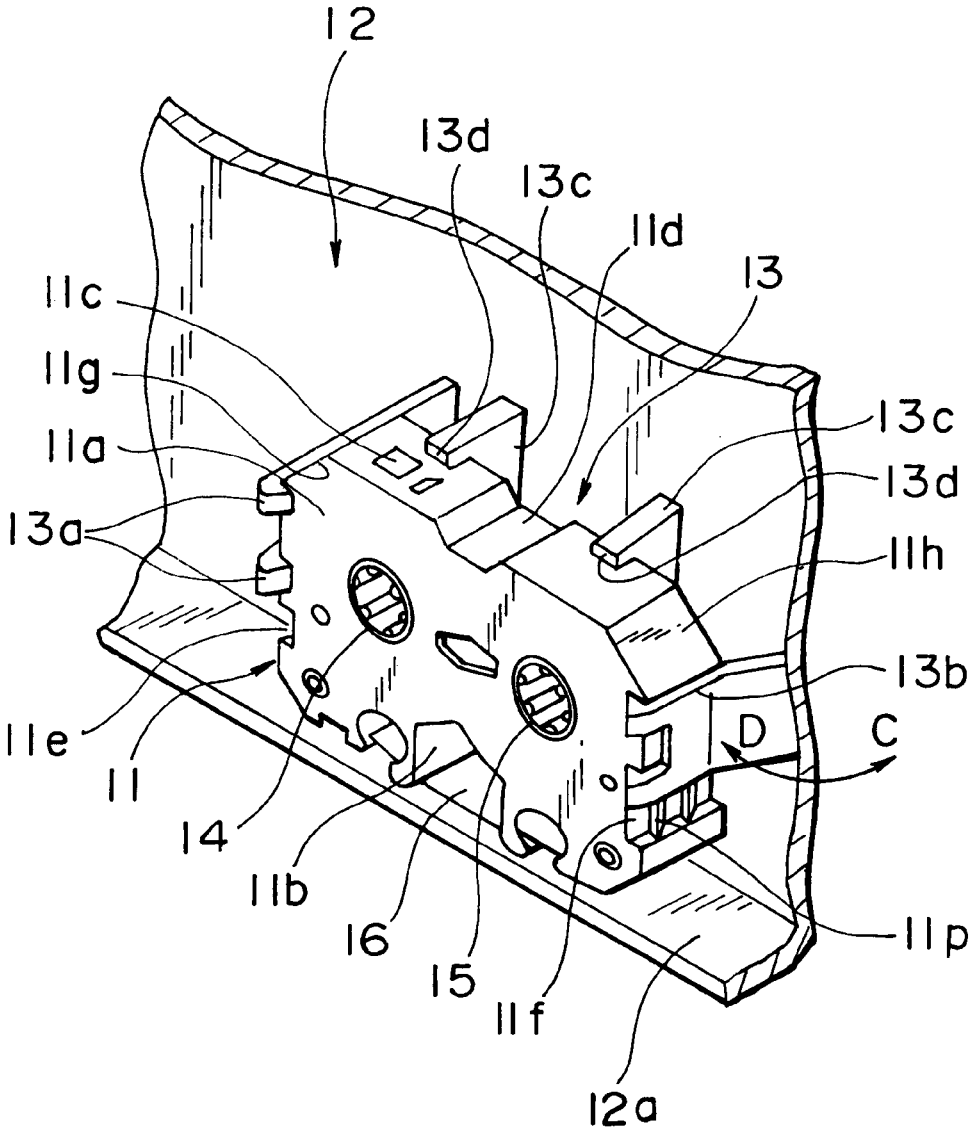
FIG. 2 is an essential-part perspective view illustrating the cassette holding structure of the cassette holding portion of the thermal transfer printer of the present invention.

As shown in FIG. 2, a recess 11*b* is formed in the main body case 11*a*. When the ribbon cassette 11 is attached to the cassette platform 10 on the carriage 4, the thermal head 3 is inserted into this recess 11*b*. Further, on the surface on the opposite side of this recess 11*b*, there is formed an identification marker 11*c* indicating the kind of ink ribbon 16 accommodated in this ribbon cassette 11.

Further, a recess lid is formed at the center of the upper side; engagement portions 11*e* and 11*f* are formed on the left and right sides; and chamfered portions 11*g* and 11*h* are formed at the upper corners. When the ribbon cassette 11 is mounted to the cassette platform 10, the stationary claw 10*g* abuts the chamfered portion 11*g*, and the stationary claw 10*h* and the movable claw 10*j* respectively abut the recesses 11*e* and 11*f* on either side, the ribbon cassette 11 being engaged by means of the engagement portions.

Further, as shown in FIG. 1, at a position opposite to the cassette platform 10 mounted on the carriage 4, there is arranged a cassette holder 12 equipped with a plurality of (four, in the example shown) cassette holding portions 13, at a predetermined distance from the cassette platform 10. The cassette holder 12 is arranged parallel to the direction of movement of the carriage 4. Further, at the lower end of the cassette holder 12, there is provided a stopper portion 12*a* for restricting downward movement of the ribbon cassette 11 held by the cassette holding portions 13. Thus, the cassette holder 12 has an L-shaped cross section.

Further, as shown in FIG. 2, the cassette holding portion 13 of the cassette holder 12 is equipped with a stationary claw 13*a*, which is a stationary member and whose forward end is divided in two. Hook-like engagement portions are formed at the forward end of stationary claw 13*a*. The stationary claw 13*a*, which is integrally formed with the cassette holding portion 13 by molding or the like, protrudes from the cassette holding portion 13. Further, at a position opposite to the stationary claw 13*a* and at a predetermined distance therefrom, a movable claw 13*b*, which is a movable member and whose forward end is divided in two, is formed as a member which is separate from the cassette holding portion 13. Hook-like engagement portions are formed at the forward end of the movable claw 13*b*. The movable claw 13*b* is rotatable around the base portion thereof. A torsion coil spring (not shown) is wound around the rotation center of this movable claw 13*b* to constantly bias the engagement portions at the forward end of the movable claw 13*b* elastically toward the stationary claw 13*a*, i.e., in the direction of an arrow D.

Further, between the stationary claw 13*a* and the movable claw 13*b*, there are formed a pair of cassette receiving portions 13*c*, which protrude from the surface of the cassette holder 12, to hold the ribbon cassette 11 on the ribbon cassette holding portion 13 in a condition in which it is separated from the surface of the cassette holder 12 by a predetermined distance. Further, protrusions 13*d* are formed at the forward ends of the cassette receiving portions 13*c* to restrict upward displacement of the ribbon cassette 11.

Figure 3:
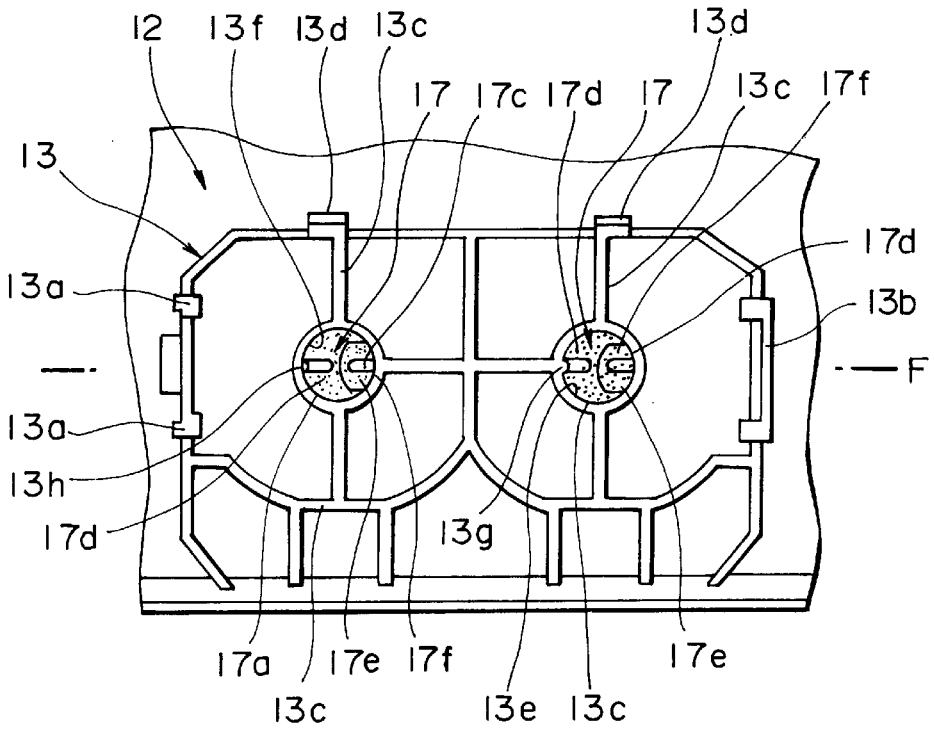
FIG. 3 is a front view of the cassette holding portion of the cassette holder of the thermal transfer printer of the present invention.

Further, as shown in the plan view of FIG. 3, two bottomed mounting holes 13*e* and 13*f* are formed in a line F, which is substantially the center line of the cassette holding portion 13. In the inner surfaces of the mounting holes 13*e* and 13*f*, on the center line F at positions nearer to the stationary claws 13*a*, there are formed, in the depth direction of the mounting holes 13*e* and 13*f*, protrusions 13*g* and 13*h* with an arcuate cross-sectional configuration and a predetermined height.

Figure 4:
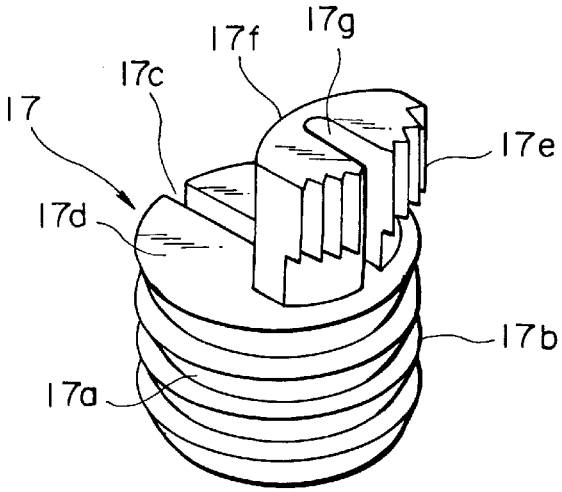
FIG. 4 is a perspective view of the elastic member of the thermal transfer printer of the present invention.

Further, elastic members 17 are forced into the mounting holes 13*e* and 13*f*. When the ribbon cassette 11 is held by the cassette holding portion 13, the elastic members 17 abut the inner walls 14*b* and 15*b* of the bobbin engagement holes 14*a* and 15*a* of the take-up reel 14 and the supply reel 15 of the ribbon cassette 11 to effect elastic biasing. These elastic members 17 are formed of a soft material, such as rubber, which is easily deformed by slight external forces and quickly restored to the former shape when there is no external force. FIG. 4 shows the configuration of the elastic member 17. As shown in the drawing, it has a cylindrical base portion 17*a* having substantially the same outer diameter as the bobbin engagement holes 14*a* and 15*a* of the take-up reel 14 and the supply reel 15 of the ribbon cassette 11. On the base portion 17*a*, there are formed a plurality of circumferential wedge-like protrusions 17*b*. Thus, the elastic member 17 can be easily forced into the mounting hole 13*e*, 13*f*. However, once forced in, it cannot be easily taken out of the mounting hole 13*e*, 13*f* due to the above-mentioned protrusions 17*b*. Further, a longitudinal expanding slot 17*c*, provided on the outer periphery of the base portion 17*a* and having a predetermined width, extends up to a position near the center of the base portion 17*a*. Further, a substantially semi-cylindrical protrusion 17*f* having an outer wall 17*e* extending along the periphery of the base portion 17*a* is formed at an end of an upper surface 17*d* of the base portion 17*a*. The outer wall 17*e* of this protrusion 17*f* has substantially the same arcuate configuration as the outer periphery of the base portion 17*a*. Since the outer diameter of the protrusion 17*f* is smaller than the diameter of the bobbin engagement holes 14*a* and 15*a* of the reels 14 and 15 of the ribbon cassette 11, the insertion of the reels 14 and 15 of the ribbon cassette 11 into the bobbin engagement holes 14*a* and 15*a* can be effected with ease. Further, a plurality of longitudinal serrations extend from the upper end of the protrusion 17*f* to a level which corresponds to substantially half the height of the protrusion 17*f*.

When forcing the base portion 17*a* of the elastic member 17 into the mounting hole 13*e*, 13*f* of the cassette holding portion 13, the protrusion 13*g*, 13*h* of the mounting hole 13*e*, 13*f* is engaged with the expanding slot 17*c* of the elastic member 17, and then the elastic member 17 is forced into the mounting hole 13*e*, 13*f*. Thus, the serrated outer wall 17*e* of the protrusion 17*f* always faces the movable claw 13*b* of the cassette holding portion 13.

Further, the protrusion 17*f* has an expanding slot 17*g* extending in the height direction provided in the outer wall 17*e* thereof. The expanding slot 17*g*, which has a predetermined width, extends outwardly in the direction opposite to the expanding slot 17*c* of the base portion 17*a* from a position near the axis of the base portion 17*a* to a level that is the same as the surface 17*d* of the base portion 17*a*.

Further, the entire outer periphery of the base portion 17*a* of the elastic member 17 is embedded in the mounting hole 13*e*, 13*f*, and only the protrusion 17*f* protrudes beyond the mounting hole 13*e*, 13*f*.

The ribbon cassette 11, which is held by the cassette holding portion 13, constructed as described above, is longitudinally pressurized by the resilient force of the torsion coil spring of the movable claw 13*b* toward the stationary claw 13*a*, and engaged by the operation of the engagement portions at their forward ends. In the vertical direction, the ribbon cassette 11 is positioned by the protrusions 13*d* of the cassette receiving portions 13*c* and the stopper portion 12*a* of the cassette holder 12. Thus, if vibrations, etc. are applied to the thermal transfer printer from outside, the ribbon cassette 11 is not detached from the cassette holding portion 13.

While in FIG. 1 the cassette platform 10 is detached from the carriage 4, in actual use, the cassette platform 10 is movably mounted to the carriage 4, the lift gear 7, which is the driving mechanism for causing the cassette platform 10 and the cassette holding portion 13 to be moved towards and moved away from each other, being in screw engagement with the screw hole 10*a* of the cassette platform 10. When the cassette platform 10 is moved toward the cassette holding portion 13 by rotating the lift gear 7, the cassette platform 10 hits the cassette receiving portions 13*c* of the cassette holding portion 13 and the movement toward the cassette holding portion 13 is stopped before the cassette platform 10 is detached from the lift gear 7, so that there is no concern that the cassette platform 10 will be detached from the lift gear 7.

In the condition in which the ribbon cassette 11 is being held by the cassette holding portion 13, the identification mark 11*c* of the ribbon cassette 11 is at a position opposite to a sensor (not shown) mounted to the sensor mounting member 9 of the carriage 4. This identification mark 11*c* is read by the sensor mounted to the sensor mounting member 9 while moving the carriage 4, whereby the kind of ribbon cassette 11 is discriminated.

In this thermal transfer printer P, constructed as described above, the ribbon cassette 11 is transferred from the cassette holding portion 13 to the cassette platform 10, and, conversely, from the cassette platform 10 to the cassette holding portion 13. This transferring operation will be described with reference to the schematic diagrams, FIGS. 5 through 16.

First, the case will be described in which the ribbon cassette 11 held by the cassette holding portion 13 of the cassette holder 12 is transferred to the cassette platform 10 to which no ribbon cassette 11 is attached.

Figure 5:
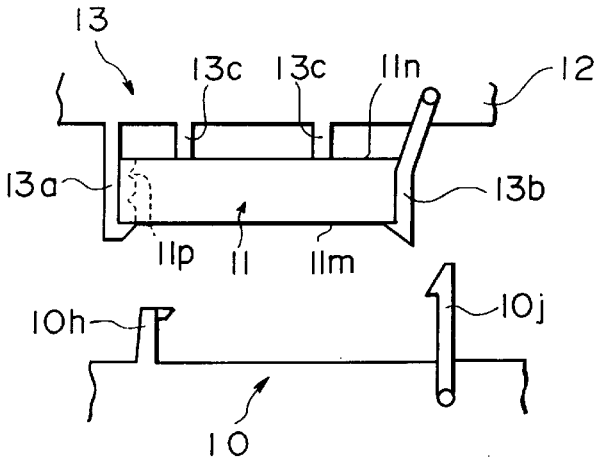
FIGS. 5 through 16 are diagrams illustrating the ribbon cassette transferring operation in the thermal transfer printer of the present invention.
Figure 6:
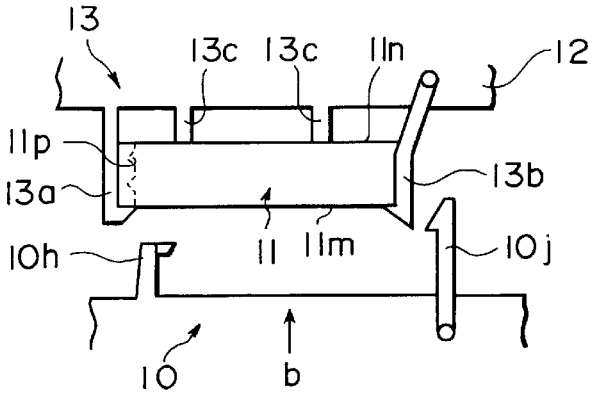

First, the carriage 4 is moved along the platen 1, and the identification mark 11*c* of the ribbon cassette 11 held by each cassette holding portion 13 is read by the sensor 9*a* mounted to the sensor mounting member 9 of the carriage 4, whereby the kind of ribbon cassette 11 is identified, and a ribbon cassette 11 accommodating an ink ribbon 16 of a desired color is selected before the carriage 4 is stopped. The positional relationship between the cassette platform 10 and the selected cassette holding portion 13 at this time is such that the engagement portion of the movable claw 10*j* of the cassette platform 10 is positioned outside the engagement portion of the movable claw 13*b* of the cassette holding portion 13. That is, the carriage 4 is stopped at a position where the movable claw 10*j* and the stationary claw 10*h* of the cassette platform 10 are somewhat deviated from the movable claw 13*b* and the stationary claw 13*a* of the cassette holding portion 13 (FIG. 5).

Next, the lift gear 7 is rotated to move the cassette platform 10 toward the cassette holding portion 13 (in the direction of the arrow b) to a position where the engagement portion at the forward end of the movable claw 10*j* of the cassette platform 10 and the engagement portion at the forward end of the movable claw 13*b* of the cassette holding portion 13 cross each other.

Figure 7:
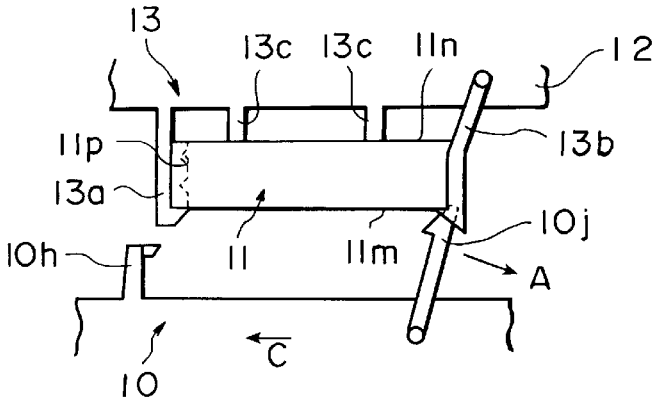

Next, when the carriage 4 is moved in the direction of the arrow c along the platen 1, the engagement portion of the movable claw 10*j* of the cassette platform 10 abuts the end portion of the ribbon cassette 11, and the movable claw 10*j* rotates in the direction of the arrow A against the resilient force of the torsion coil spring (not shown) (FIG. 7). At this time, the cassette platform 10 is moved in the direction of the arrow c until the stationary claw 10*h* of the cassette platform 10 is positioned outside the stationary claw 13*a* of the cassette holding portion 13.

Figure 8:
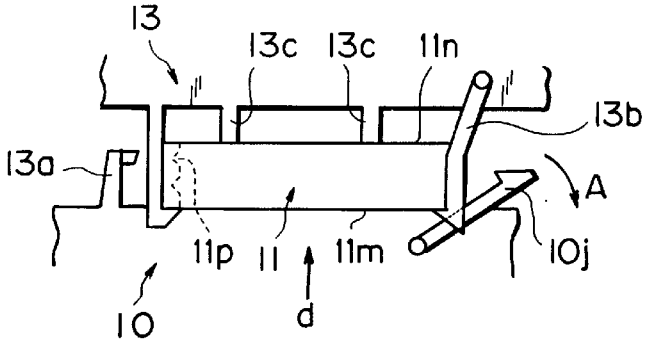

Next, the lift gear 7 of the carriage 4 is rotated again to further move the cassette platform 10 toward the cassette holding portion (in the direction of the arrow d) to thereby cause the ribbon cassette 11 to be held between the cassette platform 10 and the cassette holding portion 13. Then, the movable claw 10*j* of the cassette platform 10, which has been in contact with one end portion of the main body case 11*a* of the ribbon cassette 11 is further rotated in the direction of the arrow A, and the surface of the cassette platform 10 abuts the surface 11*m* of the ribbon cassette 11, with the result that the movement of the cassette platform 10 toward the cassette holding portion 13 (in the direction of the arrow d) is stopped (FIG. 8).

When, in this condition, the carriage 4 (the cassette platform 10) is moved in the reverse direction (in the direction of the arrow e) along the platen 1, the movable claw 13*b* of the cassette holding portion 13 rotates in the direction of the arrow C (outwards), and the engagement portion of this movable claw 13*b* is detached from the end portion of the main body case 11*a* of the ribbon cassette 11. At the same time, the engagement portion of the stationary claw 13*a* of the cassette holding portion 13 is also detached from the other end portion of the ribbon cassette 11, with the result that the base portion of the V-shaped movable claw 13*b* becomes vertical. When the base portion of the movable claw 13*b* of the cassette holding portion 13 becomes vertical, the movable claw 13*b* of the cassette holding portion 13 does not further rotate in the direction of the arrow C.

Figure 9:
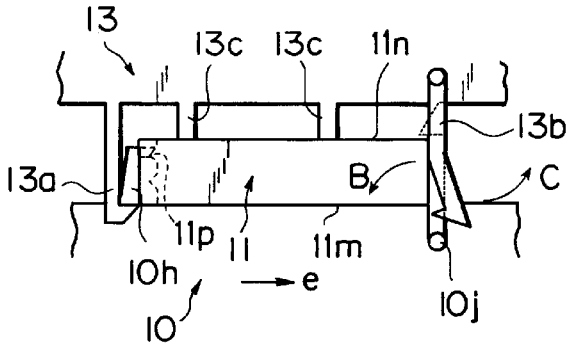

Thus, if the cassette platform 10 moves in the direction of the arrow e, the ribbon cassette 11 is stopped at the base portion of the movable claw 13*b* which has become vertical, and does not move any further in the direction of the arrow e. Due to this arrangement, only the cassette platform 10 moves in the direction of the arrow e, until the engagement portion of the stationary claw 10*h* of the cassette platform 10 is engaged with the protrusion 11*p* of one recess 11*e* of the ribbon cassette 11. The engagement portion of the movable claw 10*j* of the cassette platform 10 rotates in the direction of the arrow B due to the resilient force of the torsion coil spring to engage with the other recess 11*f* of the main body case 11*a* of the ribbon cassette 11, whereby the ribbon cassette 11, which has been held by the cassette holding portion 13, is transferred to the cassette platform 10 (FIG. 9).

That is, the carriage 4 is moved in the direction of the arrow e along the platen 1 to cancel the engagement of the ribbon cassette 11 with the engagement portions of the movable member 13*b* and the stationary member 13*a* of the cassette holding portion 13, and, at the same time, the ribbon cassette 11, which has thus been released from the engagement, is transferred to the engagement portions of the movable claw 10*j* and the stationary claw 10*h* of the ribbon cassette platform 10 to which no ribbon cassette 11 is mounted.

Figure 10:
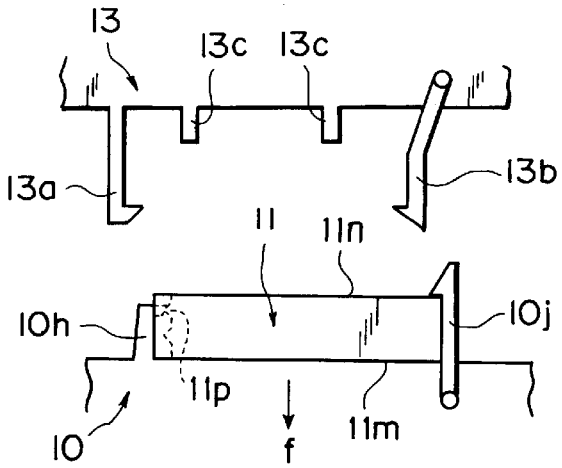

Then, the lift gear 7 is rotated in the reverse direction to move the cassette platform 10 away from the cassette holding portion 13 (in the direction of the arrow f), with the result that the ribbon cassette 11 is engaged with the stationary claw 10*h* and the movable claw 10*j* of the cassette platform 10 and separated from the cassette holding portion 13 to be returned to a predetermined position on the carriage 4, whereby the transfer from the cassette holding portion 13 to the cassette platform 10 is completed (FIG. 10).

When the cassette platform 10 is returned to the predetermined position on the carriage 4, the take-up bobbin 4*a* and the supply bobbin 4*b* of the carriage 4 shown in FIG. 1 are engaged with the take-up reel 14 and the supply reel 15 of the ribbon cassette 11. Then, the carriage 4 supported by the guide shaft 2 moves along the platen 1, whereby printing is made possible.

Next, described will be the operation of transferring the ribbon cassette 11 from the cassette platform 10 to the cassette holding portion 13 for the purpose of replacing the ribbon cassette 11 attached to the cassette platform 10 with another ribbon cassette 11.

Figure 11:
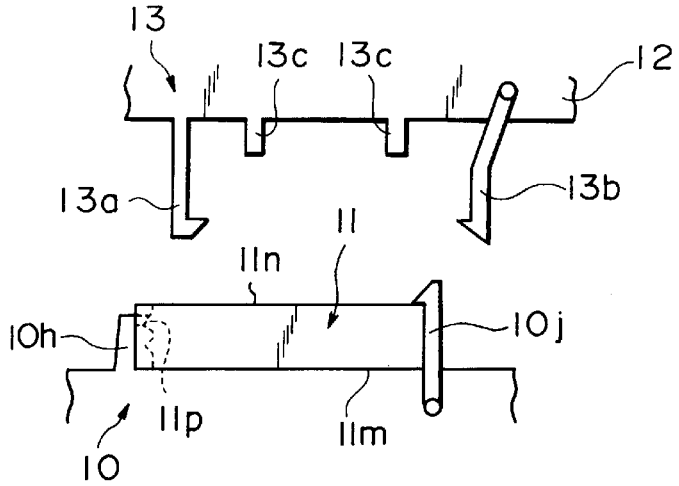

First, the cassette platform 10 with the ribbon cassette 11 mounted thereto is moved to the position of a cassette holding portion 13 holding no ribbon cassette. At this time, the cassette platform 10 is moved such that the cassette platform 10 and the cassette holding portion 13 are brought into a positional relationship in which the engagement portion of the movable claw 10*j* of the cassette platform 10 with the ribbon cassette mounted thereon is on the inner side of the engagement portion of the movable claw 13*b* of the cassette holding portion 13 holding no ribbon cassette (FIG. 11).

Figure 12:
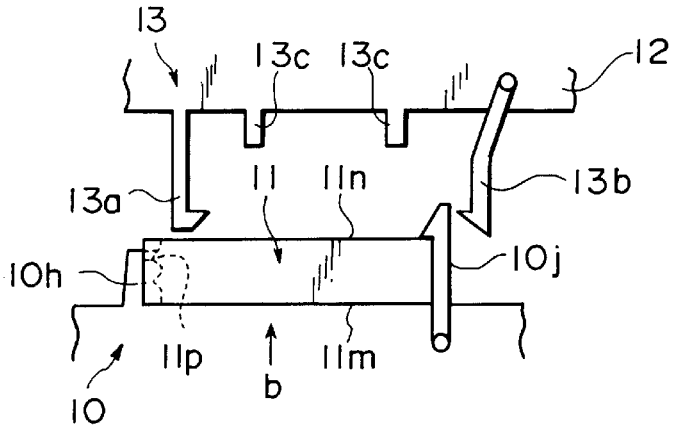

Next, the lift gear 7 is rotated to move the cassette platform 10 toward the cassette holding portion 13 (in the direction of the arrow b). At this time, the cassette platform 10 is brought close to the cassette holding portion 13 until the engagement portion of the movable claw 10*j* of the cassette platform 10 and the engagement portion of the movable claw 13*b* of the cassette holding portion 13 cross each other (FIG. 12).

Figure 13:
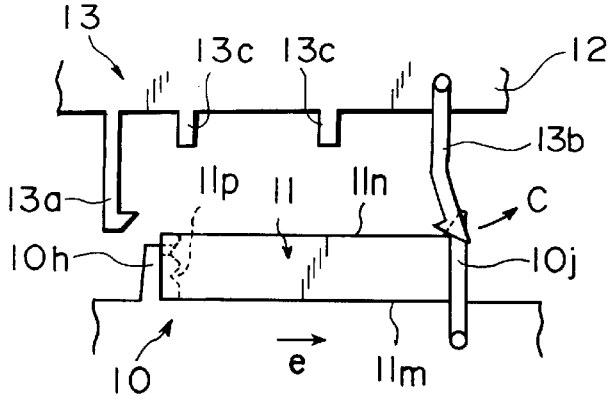

Then, in this condition, the carriage 4 is moved in the direction of the arrow e. Then, the engagement portion of the movable claw 13*b* of the cassette holding portion 13 abuts one end of the main body case of the ribbon cassette 11, and the movable claw 13*b* rotates in the direction of the arrow C (outwards) against the resilient force of the torsion coil spring (not shown), that is, so as to move away from the stationary claw 13*a*, with the result that the base portion of this movable claw 13, which has a V-shaped configuration, becomes vertical. Like the movable claw 10*j* of the cassette platform 10 described above, the movable claw 13*b* of the cassette holding portion 13 does not further rotate outwards when the base portion thereof has become vertical (FIG. 13).

Figure 14:
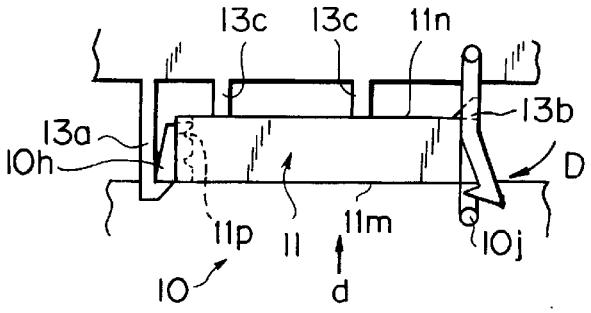

Next, the lift gear 7 is rotated to further move the cassette platform 10 toward the cassette holding portion 13 (in the direction of the arrow d) so that the ribbon cassette 11 may be held between the cassette platform 10 and the cassette holding portion 13. Then, one side surface of the ribbon cassette 11 abuts the vertical base portion of the movable claw 13*b* of the cassette holding portion 13, and the surface 11n of the ribbon cassette 11 abuts the surfaces of the cassette receiving portions 13*c* of the cassette holding portion 13, and the movement of the cassette platform 10 toward the cassette holding portion 13 is stopped (FIG. 14).

When the cassette platform 10 is moved in the direction of the arrow c, the ribbon cassette 11 abuts the stationary claw 13*a* of the cassette holding portion 13, and the engagement portion of this stationary claw 13*a* engages one side portion of the main body case 11*a* of the ribbon cassette 11. At the same time, the movable claw 13*b* of the cassette holding portion 13 is also rotated in the direction of the arrow D by the resilient force of the torsion coil spring (not shown), and engages the other end portion of the ribbon cassette 11.

Figure 15:
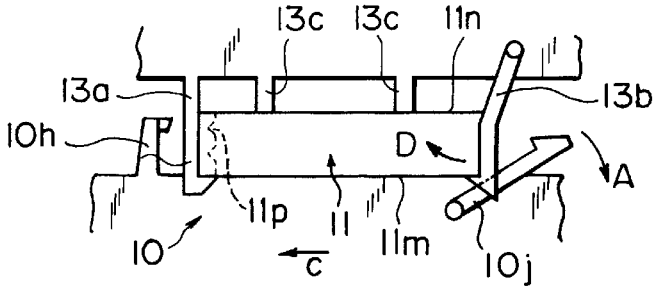
Figure 16:
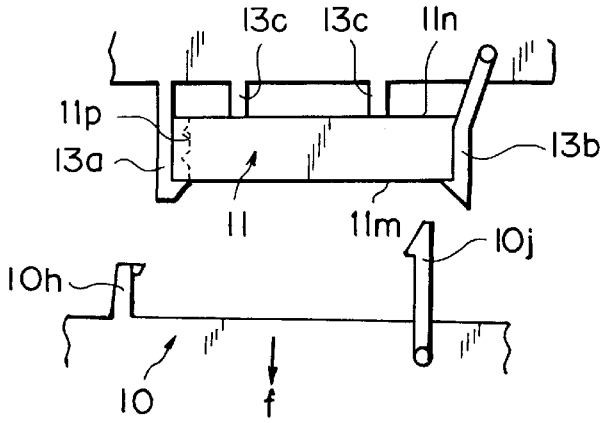

When, in this condition, the cassette platform 10 is further moved in the direction of the arrow c, the base portion of the movable claw 10*j* of the cassette platform 10 abuts one end portion of the ribbon cassette and rotates outwards in the direction of the arrow A against the resilient force of the torsion coil spring, with the result that the engagement portion of this movable claw 10*j* is detached from the main body case 11*a* of the ribbon cassette 11. At the same time, the engagement portion of the stationary claw 10*h* is also detached from the ribbon cassette 11, and the ribbon cassette 11 is transferred from the cassette platform 10 to the cassette holding portion 13. In this way, by moving the carriage 4 along the platen 1, the cassette platform 10 is moved, and the ribbon cassette 11, which has been engaged with the engagement portions of the movable member 10*j* and the stationary member 10*h* of the cassette platform 10, is brought into a non-engagement state. Further, this non-engaged ribbon cassette 11 is engaged with the movable claw 13*b* and the stationary claw 13*a* of the cassette holding portion 13, whereby the transfer of the ribbon cassette 11 is effected (FIG. 15). Then, the screw gear 7, serving as the driving mechanism, is rotated in the reverse direction to move the cassette platform 10 in the direction of the arrow f, and the cassette platform 10 is moved away from the cassette holding portion 13 to return it to the predetermined position on the carriage 4. Then, the cassette holding portion 13, which has held no ribbon cassette 11, holds the ribbon cassette 11, thus completing the transfer of the ribbon cassette 11 from the cassette platform 10 to the cassette holding portion 13 (FIG. 16).

Figure 17:
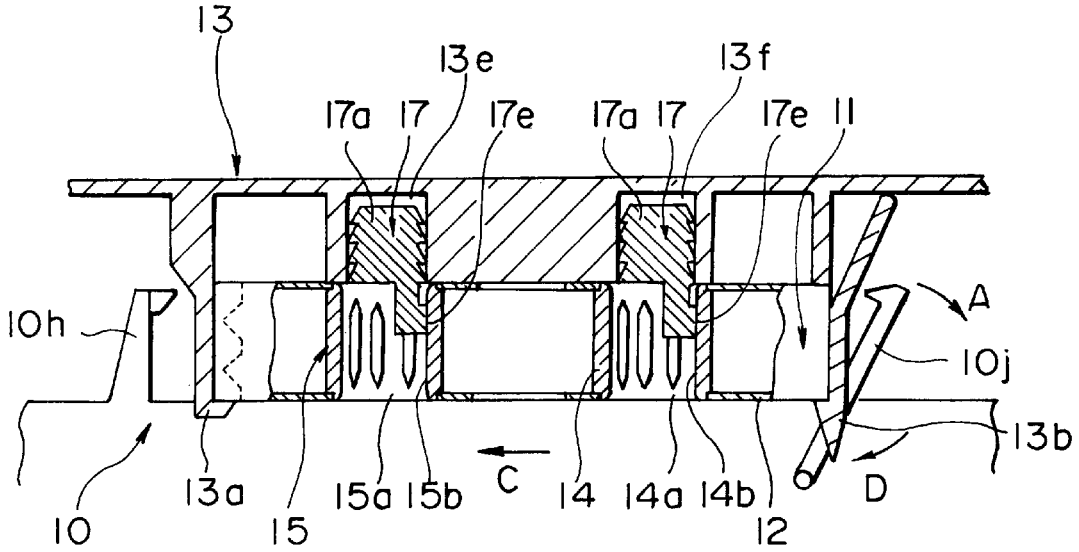
FIGS. 17 and 18 are diagrams illustrating the operation of the elastic members of the cassette holding portion when the ribbon cassette transferring operation is effected in the thermal transfer printer of the present invention.
Figure 18:
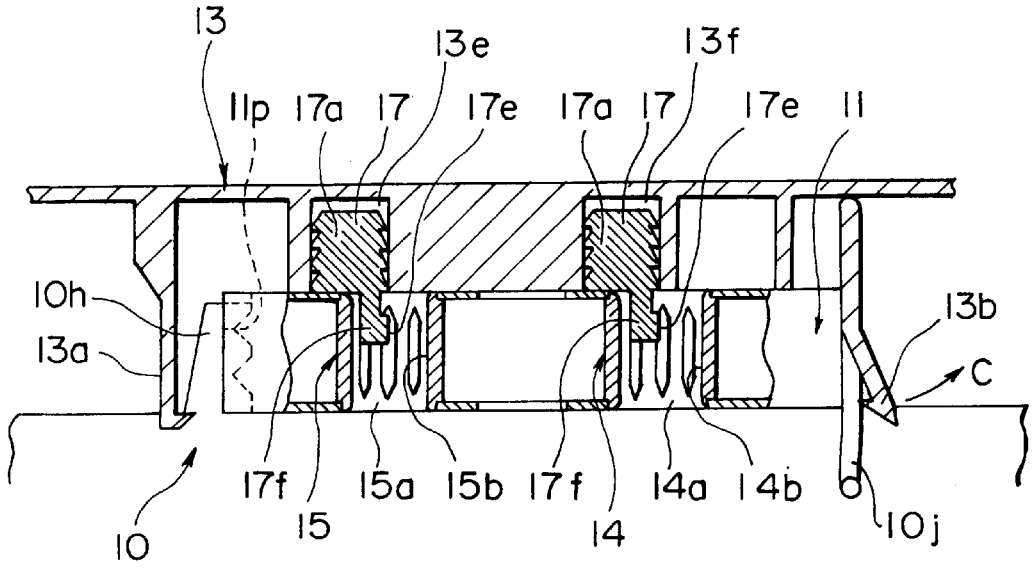
Figure 19:
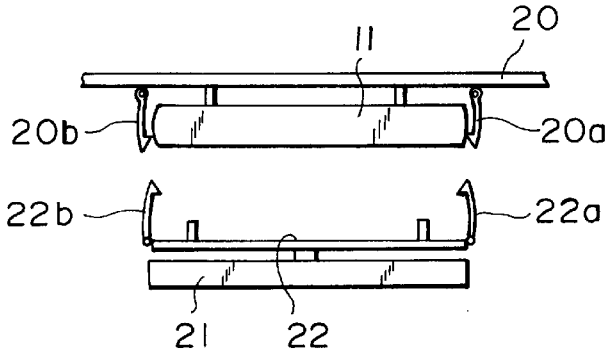
FIG. 19 PRIOR ART
FIGS. 19 through 24 are diagrams illustrating the ribbon cassette transferring operation in a conventional thermal transfer printer.
Figure 20:
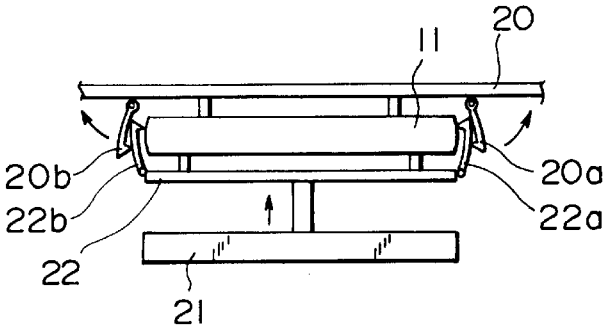
FIG. 20 PRIOR ART
Figure 21:
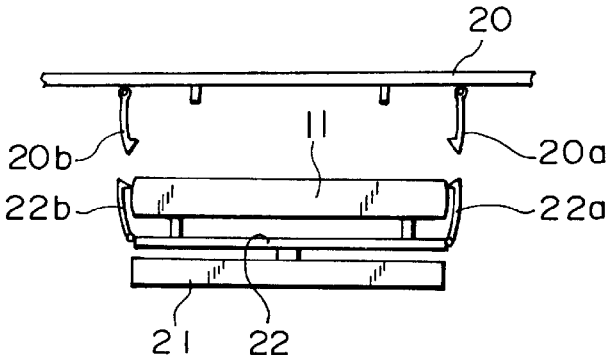
FIG. 21 PRIOR ART
Figure 22:
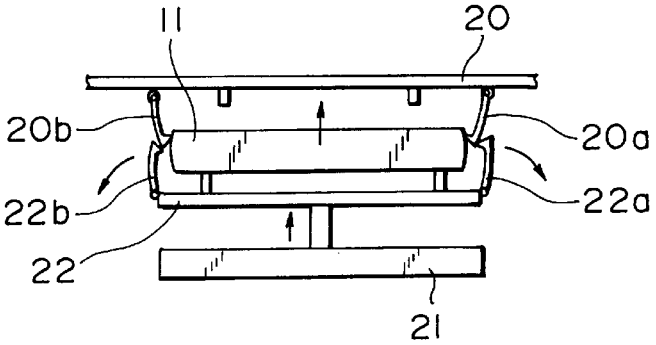
FIG. 22 PRIOR ART
Figure 23:
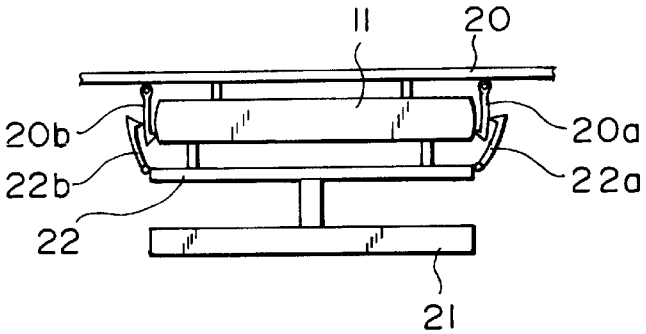
FIG. 23 PRIOR ART
Figure 24:
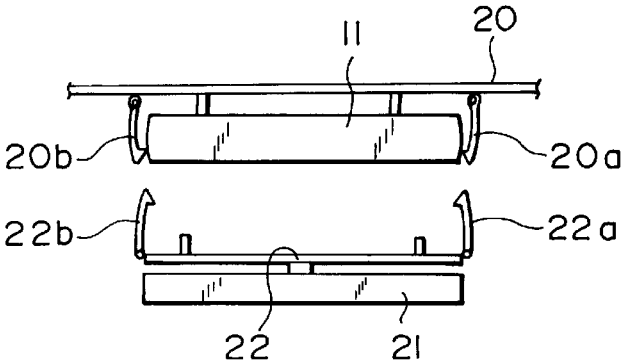
FIG. 24 PRIOR ART

As shown in detail in FIGS. 17 and 18, when the ribbon cassette 11 is transferred, as a result of the movement of the ribbon cassette 11 in the direction of the arrow C, the take-up reel 14 and the supply reel 15, which have been on the surfaces 17*d* of the elastic members 17, are detached from the surfaces 17*d*, and the outer walls 17*e* of the protrusions 17*f* abut the movable claw 16*b* side of the inner peripheral surfaces 14*b* and 15*b* of the bobbin holes 14*a* and 15*a* and elastically biased. As a result, the protrusions 17*f* of the elastic members 17 impart a rotational load to the take-up reel 14 and the supply reel 15, so that, if vibrations are applied to the ribbon cassette 11, the reels 14 and 15 make no idle running, and no slackness is generated in the ink ribbon 16.

Further, if the pressurizing force of the take-up reel 14 and the supply reel 15 is applied to the protrusions 17*f* of the elastic members 17, the elastic members 17 are not rotated to cause positional deviation of the protrusions 17*f* since the protrusions 13*g* and 13*h* of the mounting holes 13*e* and 13*f* (See FIG. 3) are engaged in the expanding slots 17*c* of the base portions 17*a*.

Further, due to the expanding slots 17*g* formed in the protrusions 17*f* of the elastic members 17, the protrusions 17*f* easily undergo elastic deformation, and, if the pressurizing force of the take-up reel 14 and the supply reel 15 is applied to the protrusions 17*f*, they can easily undergo elastic deformation, so that the engagement of the ribbon cassette 11 can be effected without a hitch.

Further, since a plurality of serrations are formed on the outer walls 17*e* of the protrusions 17*f* of the elastic members 17, elastic biasing can be reliably effected if there are a plurality of engagement protrusions on the inner peripheral surfaces 14*b* and 15*b* of the bobbin engagement holes 14*a* and 15*a*.

Further, in another embodiment, the elastic members 17 do not abut the inner peripheral surfaces 14*b* and 15*b* of the bobbin engagement holes 14*a* and 15*a* to effect elastic biasing. Instead, they may abut, for example, end surfaces of the take-up reel 14 and the supply reel 15 to elastically bias the take-up reel 14 and the supply reel 15.

As described above, in the thermal transfer printer of the present invention, stationary and movable members for engaging the ribbon cassette 11 are arranged on both the cassette platform and the cassette holding portion, and the stationary members are integrally formed with the cassette platform and the cassette holding portion, so that the number of parts can be reduced, thereby making it possible to provide a low-cost thermal transfer printer.

Further, the stationary and movable members are arranged in a direction parallel to the direction of movement of the carriage and opposed to each other at a predetermined distance, and the engagement portions of the movable members are elastically biased toward the stationary members, so that the ribbon cassette can be reliably engaged with the cassette platform or the cassette holding portion. Thus, if external vibrations, etc. are applied to the thermal transfer printer, the ribbon cassette is not detached from the cassette platform or the cassette holding portion.

Further, the ribbon cassette is transferred from the cassette holding portion to the cassette platform or from the cassette platform to the cassette holding portion through a combination of the operation of moving the cassette platform and the cassette holding portion relative to each other in the direction of movement of the carriage and the operation of causing the cassette platform and the cassette holding portion to move towards and move away from each other, so that, if the opposing positions of the cassette platform are somewhat deviated with respect to the cassette holding portion at the time of transferring, the transfer of the ribbon cassette can be effected without a hitch. Thus, there is no need to provide a positioning sensor for performing the positioning of the carriage, thereby achieving a reduction in price.

Further, elastic members adapted to abut and elastically bias the reels of the ribbon cassette when the ribbon cassette is held are mounted to the cassette holding portion, so that, if external vibrations are applied to the thermal transfer printer to cause the cassette holding portion holding the ribbon cassette to vibrate, it is possible to prevent the reels from rotating since the elastic members impart rotational load to the reels of the ribbon cassette. Thus., there is no concern that slackness will be generated in the ink ribbon, and it is possible to prevent the ribbon from getting caught by the thermal head, etc. when the ribbon cassette is transferred.

Further, since the protrusions of the elastic members abut and elastically bias the movable claw side of the inner peripheral surfaces of the bobbin engagement holes of the reels of the ribbon cassette, the protrusions of the elastic members reliably pressurize the inner peripheral surfaces of the bobbin engagement holes of the reels due to the pressurizing force of the movable claw of the cassette holding portion, so that it is possible to reliably prevent the reels from making idle running, thereby preventing slackness from being generated in the ink ribbon.

What is claimed is:

1. A thermal transfer printer comprising:

a platen arranged in a printing column direction;

a carriage arranged with respect to the platen so that the carriage can reciprocate along and move toward and away from the platen;

a carriage driving mechanism for reciprocally driving the carriage along the platen;

a ribbon cassette accommodating an ink ribbon in a case main body;

a cassette platform mounted on the carriage and equipped with a cassette engagement portion to be engaged with the ribbon cassette, the cassette engagement portion including a movable member and a stationary member;

a cassette holder arranged at a position opposite to the cassette platform and having a plurality of cassette holding portions each having a cassette engagement portion engageable with the ribbon cassette, each cassette engagement portion having a movable member and a stationary member;

a driving mechanism for moving the cassette platform towards and away from the cassette holder; and wherein, in the cassette engagement portion of the cassette platform and in the cassette engagement portion of each cassette holding portion, the movable members and the stationary members are arranged parallel to the direction of movement of the cassette platform and the stationary member is arranged opposite the movable member on both the cassette platform and the cassette holding portion.

2. A thermal transfer printer according to claim 1, wherein biasing members are mounted to the movable members and wherein the movable members are elastically biased toward the stationary members by the biasing members.

3. A thermal transfer printer comprising:

a platen arranged in a printing column direction;

a carriage arranged with respect to the platen so that the carriage can reciprocate along and move toward and away from the platen;

a carriage driving mechanism for reciprocally driving the carriage along the platen;

a ribbon cassette accommodating an ink ribbon in a case main body;

a cassette platform mounted on the carriage and equipped with a cassette engagement portion to be engaged with the ribbon cassette, the cassette engagement portion including a movable member and a stationary member;

a cassette holder arranged at a position opposite to the cassette platform and having a plurality of cassette holding portions each having a cassette engagement portion engageable with the ribbon cassette, each cassette engagement portion having a movable member and a stationary member;

a driving mechanism for bringing the cassette platform towards and away from the cassette holder;

elastic members which are attached to said cassette holding portion and which abut the reels of the ribbon cassette when said ribbon cassette is held by the cassette holding portion so as to elastically bias the reels in one direction.

4. A thermal transfer printer according to claim 3, wherein the cassette holding portion is equipped with a stationary member integrally formed with the cassette holding portion and a movable member attached to the cassette holding portion, and wherein the ribbon cassette, having a supply reel and a take up reel having bobbin engagement holes with inner peripheral surfaces, mounted on the cassette platform is transferred to the cassette holding portion through an operation of moving the cassette platform with the ribbon cassette mounted thereon in a direction perpendicular to the carriage moving direction to bring it into contact with the cassette holding portion and an operation of moving the cassette platform in the carriage moving direction, the elastic members abutting inner peripheral surfaces of bobbin engagement holes of the reels when the ribbon cassette is held by the cassette holding portion by means of the movable and stationary members.

5. A thermal transfer printer according to claim 4, wherein mounting holes are formed in the cassette holding portion, wherein protruding portions protruding from the mounting holes are provided on the elastic members mounted to the mounting holes, and wherein the protruding portions are inserted into the bobbin engagement holes of the ribbon cassette to cause the elastic members to abut the movable member side of the inner peripheral surfaces of the bobbin engagement holes to elastically bias them.

6. A thermal transfer printer according to claim 5, wherein each of the elastic members has a cylindrical base and a substantially semi-cylindrical protruding portion with an outer wall formed along the circumferene of the base, the base being mounted to the mounting hole of the cassette holding portion.

7. A thermal transfer printer according to claim 5, wherein the protruding portion of the elastic member has an expanding slot in the height direction provided in the outer wall thereof.

* * * * *